United States Patent [19]

Schuller

[11] 4,032,039

[45] June 28, 1977

[54] ARTICLE-DISPENSING APPARATUS

[75] Inventor: James T. Schuller, St. Louis County, Mo.

[73] Assignee: UMC Industries, Inc., Stamford, Conn.

[22] Filed: Nov. 13, 1975

[21] Appl. No.: 631,531

[52] U.S. Cl. ..... 221/75; 221/124; 221/133

[51] Int. Cl.[2] ..... G07F 11/36

[58] Field of Search ..... 221/75, 92, 123, 124, 221/129, 130, 133

[56] References Cited

UNITED STATES PATENTS

| | | | |
|---|---|---|---|
| 3,094,241 | 6/1963 | Lashley | 221/129 X |
| 3,155,274 | 11/1964 | Williams et al. | 221/130 |
| 3,335,907 | 8/1967 | Holstein et al. | 221/130 X |
| 3,601,237 | 8/1971 | Ovsienko | 221/129 X |

*Primary Examiner*—Robert B. Reeves
*Assistant Examiner*—Joseph J. Rolla
*Attorney, Agent, or Firm*—Koenig, Senniger, Powers and Leavitt

[57] ABSTRACT

A vendor comprising a cabinet having a first and a second bank of article dispensers therein, each bank comprising a plurality of dispensers located one above another, each dispenser being adapted to feed articles toward one end of the dispenser and discharge the leading article to drop by gravity, the two banks feeding to a common drop space in the cabinet, and a closure for closing off either the first or the second bank from the drop space.

9 Claims, 6 Drawing Figures

ARTICLE-DISPENSING APPARATUS

BACKGROUND OF THE INVENTION

This invention relates to article-dispensing apparatus, and more particularly to such apparatus of the class having dispensers located one above another which dispense articles from one end thereof to drop by gravity.

The invention is especially concerned with developments in the type of vendors sometimes referred to as spiral vendors, having helical coils on shelves such as shown in the coassigned U.S. Pat. No. 3,335,907 of Alvin W. Holstein and James T. Schuller, issued Aug. 15, 1967, for adaptation thereof to vend postal commodities such as stamp booklets, post cards and envelopes, though not limited to such use.

SUMMARY OF THE INVENTION

Among the several objects of the invention may be noted the provision of article-dispensing apparatus of the class described having an increased number of dispensers within a given cabinet space; the provision of such apparatus in which the article drop space in the cabinet is reduced to increase the space available for stocking articles to be dispensed; and the provision of such apparatus adapted reliably to dispense flat and relatively light articles, such as the postal commodities above described, despite the tendency of such articles to sail as they drop.

In general, article-dispensing apparatus of this invention comprises a cabinet, a first and a second bank of article dispensers in the cabinet, each bank comprising a plurality of dispensers located one above another, each dispenser being adapted to hold a series of articles to be dispensed in a row extending toward one end of the dispenser and having means for feeding the articles toward said one end of the dispenser and discharging the leading article of the series to drop by gravity, the first bank and the second bank of dispensers being arranged in the cabinet with the dispensers of the first bank feeding in one direction and the dispensers of the second bank feeding in the opposite direction and with the discharge ends of the dispensers of the first bank spaced from the discharge ends of the dispensers of the second bank providing a common vertical discharge chute between said bands, and said cabinet having a delivery station to which an article delivered from any of the dispensers drops down in said chute. By having the common vertical discharge chute between the two banks, the drop space in the cabinet is reduced to enable increased utilization of space for stocking articles in the cabinet. A closure is provided movable between a first position extending heightwise in said chute at the discharge ends of the dispensers of the first bank for closing off the first bank from the chute and a second position extending heightwise in the chute at the discharge ends of the dispensers of the second bank for closing off the second bank from the chute.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 4:
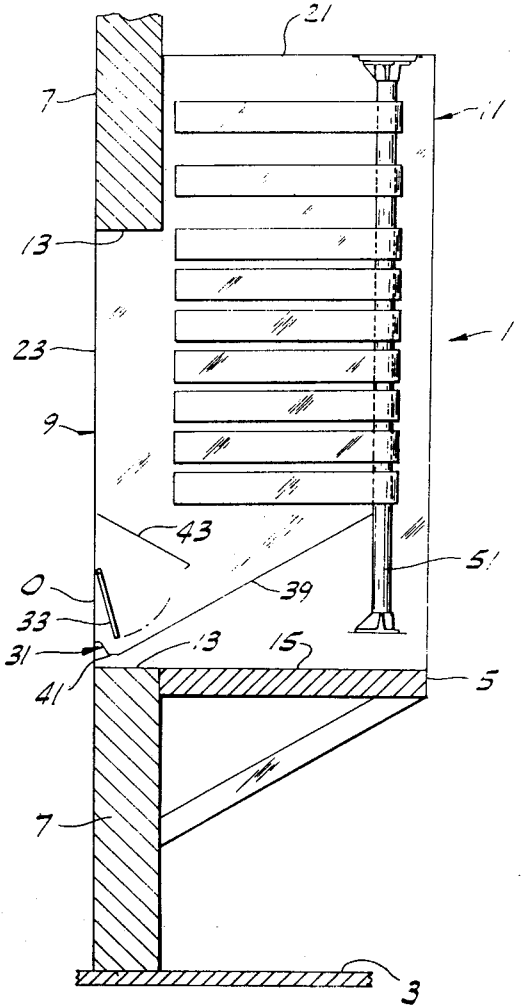
FIG. 4 is a vertical section on line 4—4 of FIG. 2.

Referring to the drawings, an article-dispensing apparatus or vendor of this invention is shown to comprise a cabinet 1 to be mounted above the floor 3 on a platform 5 behind a wall 7 (see FIG. 4). The cabinet has a lower section 9 and an upper section 11, the lower section being deeper than the upper section and projecting forward through an opening 13 in the wall. The upper section 11 extends up above the level of the top of the opening 13 behind the wall. The cabinet has a bottom 15, side walls 17 and 19, a top 21, a front wall 23, and folding doors 25 and 27 for closing its rear.

In accordance with this invention, a first bank B1 of article dispensers and a second bank B2 of article dispensers are provided in the cabinet. Bank B1 is the left bank and bank B2 is the right bank as shown in FIG. 2, "left" and "right" being as viewed from the rear of the vendor (through which it is loaded). Each bank comprises a plurality of dispensers located one above another, each dispenser being adapted to hold a series of articles to be dispensed in a row extending toward one end of the dispenser constituting its discharge end and having means for feeding the articles toward said discharge end and discharging the leading article of the series to drop by gravity. The dispensers of bank B1 are designated D1 and those of bank B2 are designated D2. The discharge end of each dispenser D1 is designated E1 and the discharge end of each dispenser D2 is designated E2. The first and second banks B1 and B2 of dispensers D1 and D2 are arranged in the cabinet with the dispensers D1 of the first bank B1 feeding in one direction (left to right as viewed in FIG. 2) and the dispensers D2 of the second bank B2 feeding in the opposite direction (right to left as viewed in FIG. 2). The discharge ends E1 of the dispensers D1 of the first bank B1 are spaced from the discharge ends E2 of the dispensers D2 of the second bank B2 providing a drop space constituting a common vertical discharge or delivery chute 29 between the two banks. As shown in FIG. 2, dispensers D1, which extend toward the right from adjacent the side wall 19 of the cabinet, are somewhat larger (longer) than dispensers D2, which extend toward the left from adjacent the side wall 17 of the cabinet. Consequently, the discharge or delivery chute 29 is located somewhat to the right of center of the cabinet as viewed from the rear in FIG. 2 (and somewhat to the left of center of the cabinet as viewed from the front in FIG. 1).

An article delivered from any one of the dispensers D1 or D2 drops down through the delivery chute 29 between the two banks B1 and B2 of dispensers into a delivery pan 31 providing a delivery station at the bottom of the cabinet, from which it may be taken out by the purchaser via an access or delivery opening O in the front wall 23 of the cabinet. A door for the delivery opening O is indicated at 33. As shown in FIG. 2, the delivery pan is somewhat wider than the delivery chute 29, having left- and right-side walls 35 and 37 with the left-side wall spaced to the left of the discharge ends E1 of dispensers D1 (i.e., to the left of the left side of chute 29) and the right-side wall spaced to the right of the discharge ends E2 of dispensers D2 (i.e., to the right of the right side of chute 29). The pan lies below the banks B1 and B2 of dispensers, having a bottom panel 39 slanting downwardly from adjacent the rear of the cabinet toward the front of the cabinet at the bottom of the chute 29 to a trough 41 adjacent the front of the cabinet at the bottom of the access opening O. Any dispensed article dropping down in the chute 29 falls onto this inclined panel 39 and slides down it into the trough. An inclined baffle 43 is provided slanting downward toward the rear of the cabinet from the front wall above the access opening O.

Each of the dispensers D1 and D2 is preferably of the type shown in the aforesaid U.S. Pat. No. 3,335,907 comprising an elongate rectangular shelf 45 carrying a plurality of helices 47 (e.g., a pair of helices) extending lengthwise of the shelf, each helix being adapted to receive articles A to be dispensed between its convolutions for screw-feeding them toward and off the discharge end (E1 or E2) of the shelf. Each helix is adapted to be driven by its own electric motor mounted at the other end of the shelf from the discharge end. The motors of dispensers D1 are designated M1 and those of dispensers D2 are designated M2.

The shelves 45 of the left bank B1 are mounted one above another on a vertical post 49 located adjacent the left rear corner of the cabinet for individual horizontal swinging movement thereof about the axis of post 49, and the shelves 45 of the right bank B2 are mounted one above another on a vertical post 51 located adjacent the right rear corner of the cabinet for individual horizontal swinging movement thereof about the axis of post 51.

Figure 2:
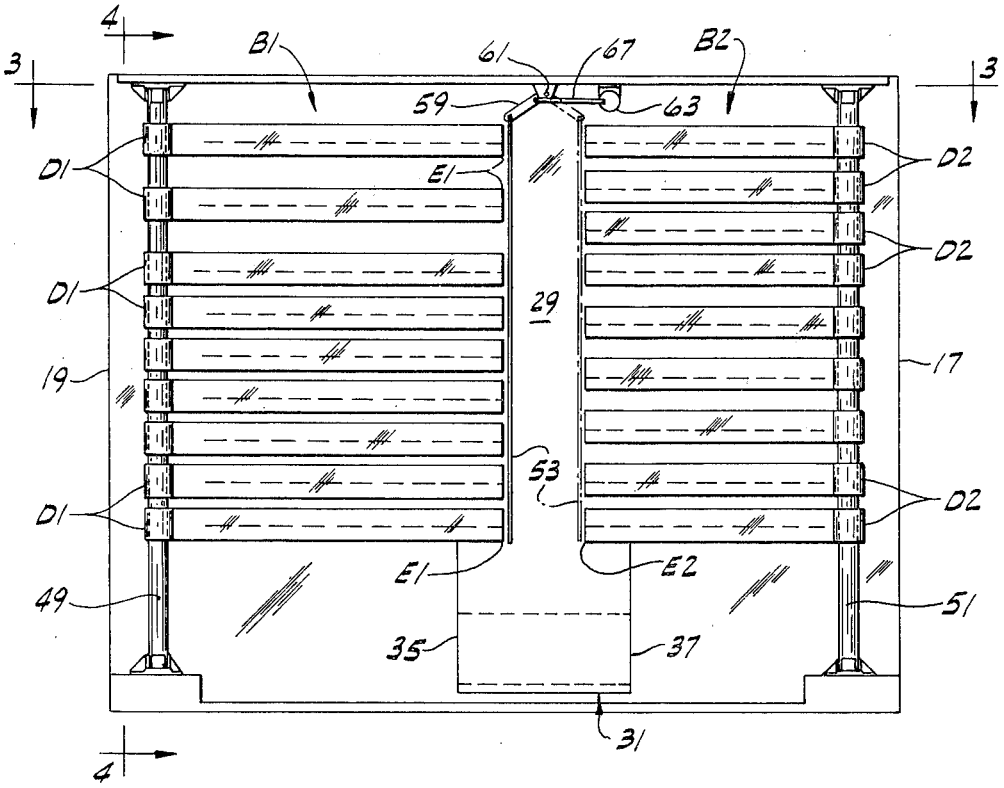
FIG. 2 is a rear elevation of the apparatus with certain doors of the cabinet of the apparatus open.
Figure 3:
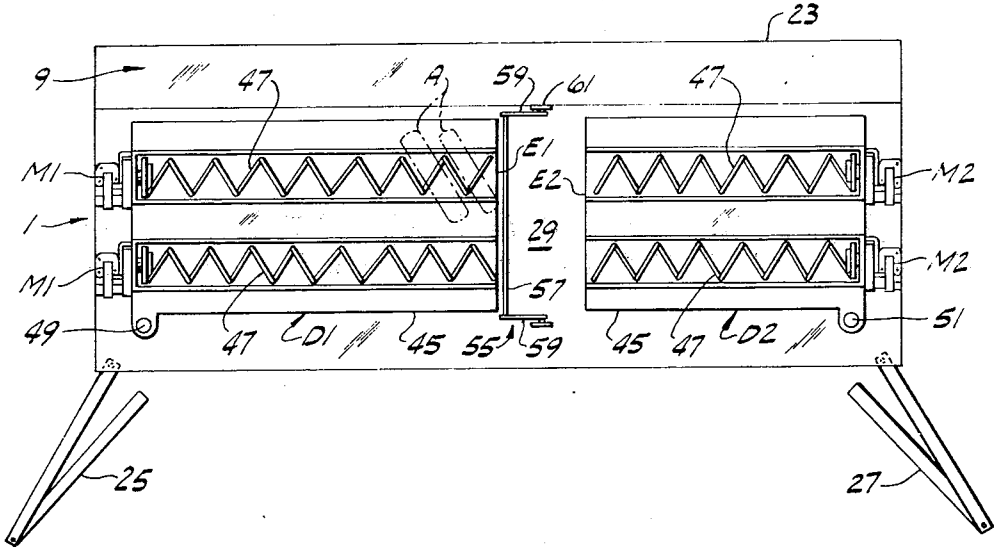
FIG. 3 is a horizontal section on line 3—3 of FIG. 2.
Figure 5:
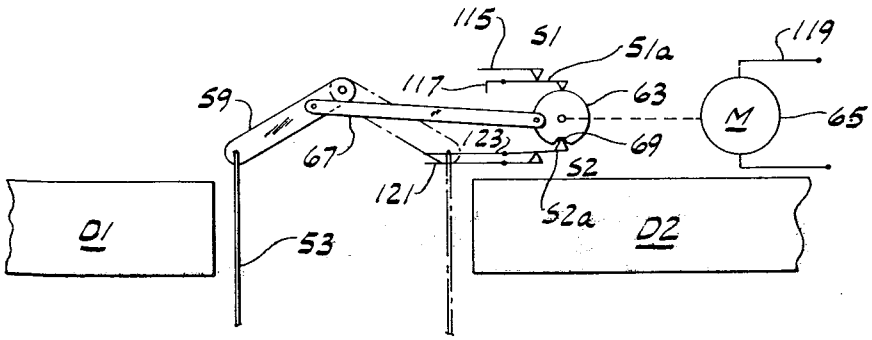
FIG. 5 is a detail showing certain partition-operating mechanism.

Further in accordance with this invention, there is provided a closure 53 movable between a position (shown in solid lines in FIG. 2) extending heightwise in the chute 29 at the discharge ends of dispensers D1 at the left side of the chute for closing off the bank B1 from the chute and a position (shown in dotted lines in FIG. 2) extending heightwise in the chute at the discharge ends of dispensers D2 at the right side of the chute for closing off the bank B2 from the chute. Closure 53 is constituted by a curtain or partition of any suitable material (e.g., cloth, sheet metal, wire mesh) having a height somewhat greater than the height of banks B1 and B2 and a width somewhat greater than the width of the shelves. As shown in FIGS. 2, 3 and 5, means 55 is provided at the top of the cabinet for holding the closure 53 with the closure hanging down in the chute 29, this means being movable for moving the closure between its two positions. This means 55 is in the form of a swinging frame comprising a rod 57 extending between the lower free ends of a pair of arms 59 pivoted for swinging movement as indicated at 61 on an axis extending in front-to-rear direction with respect to the cabinet generally in the central vertical plane of the chute. The closure hangs down from the rod 57. The frame 55 is swingable back and forth to shift the closure between its two positions by means of a crank disk 63 driven by an electric motor 65 and connected by a link 67 to one of the arms 59.

Figure 6:
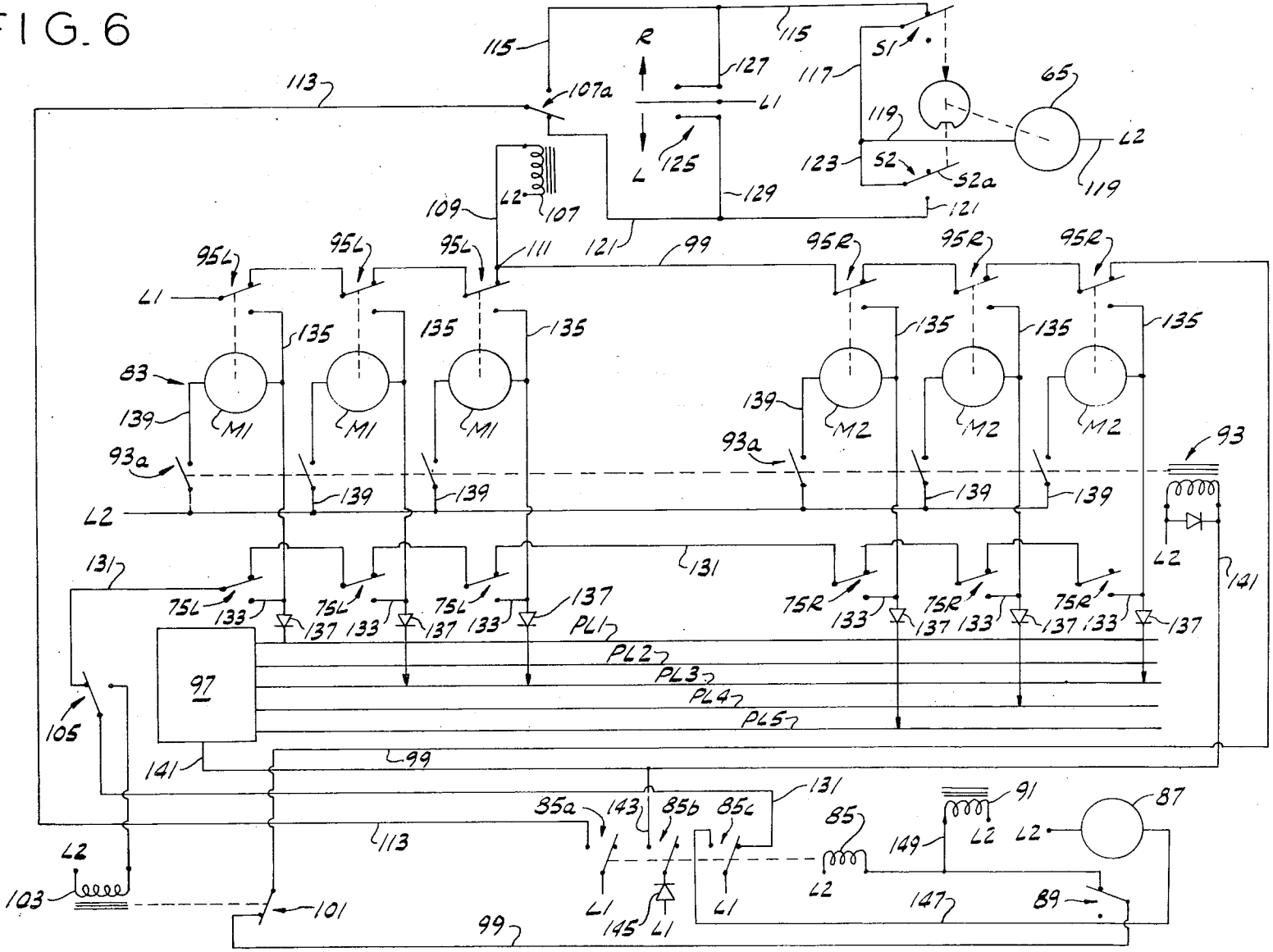
FIG. 6 is a wiring diagram.

The motor is shown as operable to drive the crank disk 63 through a half-revolution cycle by providing a notch 69 in the disk to utilize it as a cam and providing a pair of switches S1 and S2 for controlling the motor, each having its operating arm engageable with the periphery of the disk. It will be understood that the crank may be a separate element from the cam. As shown in FIGS. 5 and 6, the operating arm S2*a* of which is in the notch 69 and switch S2 is open. The operating arm S1*a* of switch S1 engages the periphery of the disk 180° around from the point where the operating arm of switch S2 engages the periphery of the disk, and switch S1 is closed. In this position of the crank disk, the frame 55 is in its left-hand position of FIGS. 2, 3 and 5 and the closure 53 is at the left of the chute 29, closing off bank B1.

Figure 1:
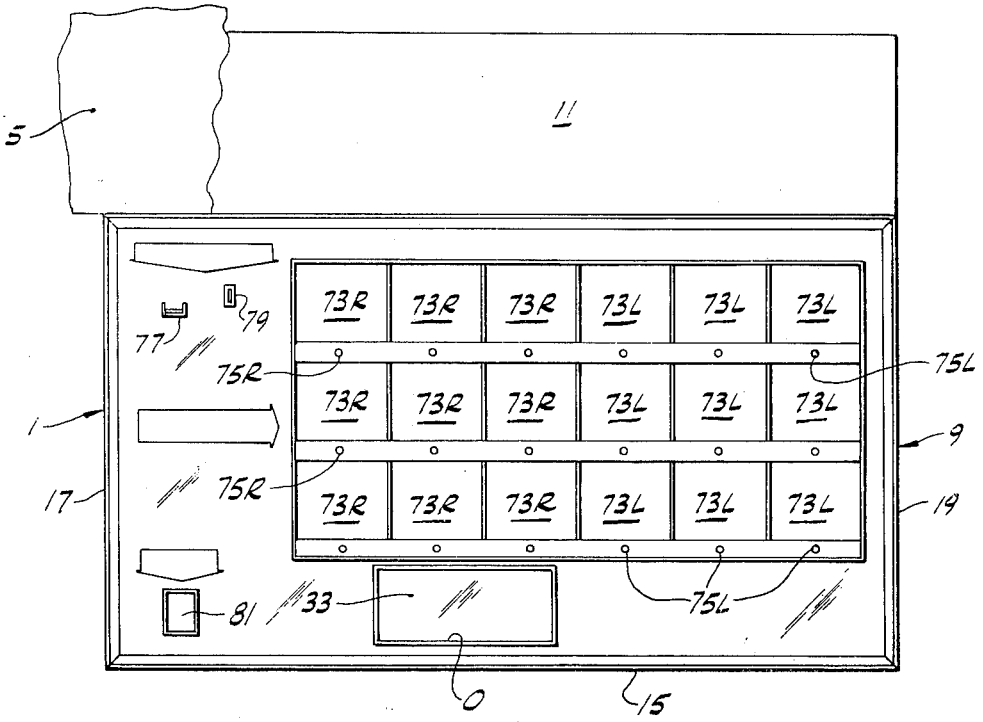
FIG. 1 is a front elevation of an article-dispensing apparatus of this invention.

As shown in FIG. 1, displays such as indicated at 73L are provided on the front of the cabinet for the articles stocked in the dispensers D1 of bank B1 and displays such as indicated at 73R are provided for the articles stocked in the dispensers D2 of bank B2. Below each of the displays 73L is a pushbutton switch 75L for making a selection from the respective dispenser D1 and below each of the displays 73R is a pushbutton switch 75R for making a selection from the respective dispenser D2. As herein illustrated, there are nine dispensers in each bank, and FIG. 1 shows nine displays 73L and selection switches 75L, and nine displays 73R and selection switches 75R. Each dispenser is shown as having two helices therein, both of these being stocked with the same items, and both being driven by a commmon motor M1 or M2 in the manner disclosed in the Schuller U.S. Pat. No. 3,469,738, issued Sept. 30, 1969. Slots for insertion of bills and coin are indicated at 77 and 79 in FIG. 1; a money return cup is indicated at 81.

Now referring to FIG. 6, three of the motors M1 for the dispensers D1 of the left bank B1 are shown and three of the motors M2 for the dispensers D2 of the right bank B2 are shown, the remainder being omitted on account of space limitations on the drawing. The motors M1 and M2 are connected in a circuit 83 with motors M1 under control of selection switches 75L and motors M2 under control of selection switches 75R. The circuit includes a relay 85 having three sets of contacts 85*a*, 85*b* and 85*c*, a coin-handling motor 87 controlling a switch 80, and a coin return electromagnet 91. Also shown is a relay 93 having a set of contacts 93*a* controlling the motors M1 and M2 and cycle switches 95L and 95R controlled by cams (not shown) each driven by a respective motor M1 or M2 to provide a holding circuit for operating the motor through a single cycle for dispensing an item from the respective dispenser on actuation of the respective selection switch 75L or 75R after having deposited the appropriate amount of money. The circuit further includes five price lines PL1–PL5 extending from a totalizer 97, with various selection switches connected to various of these lines.

The cycle switches 95L and 95R for the motors M1 and M2 are double-throw switches connected between power lines such as indicated at L1 and L2 in a circuit 99, which includes a cancel solenoid switch 101, the coin-handling motor switch 89 and the relay 85. The cancel solenoid switch is controlled by a cancel solenoid 103 which in turn is controlled by a cancel switch 105 for cancelling a selection. At 107 is indicated a relay connected by a line 109 to circuit 99 at a junction 111 between the series of left cycle switches 95L and the series of right cycle switches 95R. Relay 107 is normally energized via the left cycle switches 95L, and is deenergized to drop out when any one of the left cycle switches 95L is actuated (i.e., closed on its lower contact to provide a holding circuit for the respective motor M1). Relay 107 remains energized, however, when any one of the right cycle switches 95R is actuated.

Relay 107 has a set of double-throw contacts 107*a*. Contacts 85*a* of relay 85 are connected in a line 113 between power line L1 and the movable contactor of set 107*a*. Switch S1 and motor 65 are connected in series between the upper contact of set 107*a* and line L2 via lines 115, 117 and 119. Switch S2 and motor 65 are connected in series between the lower contact of set 107*a* and line L2 via lines 121, 123 and 119. At 125 is indicated a normally open double-throw manual switch, having its movable contactor powered from line L1, its upper contact connected via line 127 to line 115 and its lower contact connected via line 129 to line 121. When switch 125 is closed on its upper contact, it energizes motor 65 to move closure 53 to the right and when it is closed on its lower contact, it energizes motor 65 to move closure 53 to the left.

The set of contacts 85*c* of relay 85 is a double-throw set, including a movable contactor connected to line L1 normally closed on the right contact as shown when relay 85 is energized. Each of the selection switches 75L and 75R has a movable contactor normally closed on an upper contact as shown, and movable down onto a lower contact by a purchaser to make a selection. The selection switches have their movable contactors and upper contacts connected in a line 131 extending from the right contact of set 85*c* of relay 85, this line 131 including the cancel switch 105. Each selection switch has its lower contact connected as indicated at 133 to a line 135 interconnecting the lower contact of the respective cycle switch 95L or 95R and one of the price lines PL1–PL5. Thus, for example, the selection switch 75L at the left of FIG. 6 has its lower contact connected via the respective line 133 to a line 135 interconnecting the lower contact of the motor M1 at the left of FIG. 6 and price line PL1. Each line 135 includes a diode 137 between the respective line 133 and the respective price line. Each of the motors M1 and M2 is connected in series with a respective set of contacts 93*93* of the relay 93 in a line 139 between the respective line 135 ans line L2.

The totalizer 97 includes conventional known means for interconnecting each of the price lines PL1–PL5 to a line 141 whenever a purchaser has inserted coin in the vendor in amount corresponding to the price represented by that price line. Thus, assuming price line PL1 represents a price of 25 cents, the totalizer completes a circuit between lines PL1 and line 141 whenever 25 cents in coin is deposited. Assuming price line PL2 represents a price of 25 cents, the totalizer completes a circuit between line PL2 and line 141 whenever thirty-five cents in coin is deposited. Relay 93 is connected in line 141 between the totalizer and line L2 for energization whenever line 141 is energized. The set of contacts 85*b* of relay 85, which are normally open with relay 85 energized, is connected via a line 143 in series with a diode 145 between line L1 and line 141. Motor 87 is connected in a line 147 between the left contact of the set of contacts 85*c* and line L2. Electromagnet 91 is connected in a line 149 between line 99 and line L2.

Relay 85 is normally energized via the movable contactors of the cycle switches 95L and 95R being closed on their upper contacts as shown in FIG. 6 and via switches 89 and 101 being closed, and its contacts 85*a* are thus normally open as shown. Relay 85 is denergized to close contacts 85*a* to deliver power to the movable contactor of the contact set 107*a* of relay 107 when any one of the cycle switches 95L or 95R is thrown by its respective cam (not shown) on operation of the respective motor M1 or M2, or when switch 89 or switch 101 is opened.

As shown in FIG. 6, switch S1 is closed and switch S2 is open, and as shown in FIGS. 2, 3 and 5, the closure or curtain 53 is at the left closing off the left dispensers D1. Under these circumstances, if a selection is made from any one of the left dispensers D1 by actuating the respective selection switch 75L (after having deposited a sufficient amount of money), relay 107 is deenergized, with the result that the movable contactor of its set of contacts 107*a* closes on its upper contact. Also, relay 85 is deenergized, thereby closing contacts 85*a* and 85*b*, and throwing the movable contactor of set 85*c* on to its left contact. This occurs because actuation of the switch 75L starts the respective motor M1, which in turn throws down the movable contactor of the respective cycle switch 95L to break circuit 99. In this regard, on actuation of the switch 75L by the purchaser, a circuit is completed for relay 93 from line L1 via the movable contactor of set 85*c* closed on the right contact, line 131, the respective line 133 and the respective price line, and line 141 to line L2. This closes contacts 93*a*, completing a circuit for the motor M1 via the respective line 139. The respective cycle switch 95L is then thrown via its cam to provide a holding circuit for the motor from line L1 via the switch 95L, line 135 and line 139 to line L2. With contacts 85*a* closed, power is delivered via line 113 to the movable contactor of relay 107 which is up on its upper contact and motor 65 is energized from line 113 via line 115, switch S1 and lines 117 and 119 to operate through a half-revolution cycle of the disk 63 to the point where notch 69 in the disk opens switch S1. Switch S2 closes shortly after disk 63 starts rotating and is closed when the disk stops at the end of its half revolution. The closure moves to the right to its position illustrated in dotted lines in FIG. 2 at the discharge ends of dispensers D2 at the right of chute 29, closing off the bank B2 of dispensers from the chute. Accordingly, an article may be dispensed from the dispenser D1 of bank B1 (via the closure moving away from the discharge end of this dispenser) and the article is prevented from sailing into bank B2 by reason of the closure closing off the latter bank. When closure 53 is at the left as shown in solid lines in FIG. 2 with switch S1 closed and switch S2 open as shown in FIG. 6, and a selection is made from any one of dispensers D2 in the right bank B2 by actuating a selection switch 75R, relay 107 remains energized via switches 95L and the closure 53 remains at the left to enable dispensing from bank B2 and to prevent the dispensed article from sailing into bank B1.

Assuming that the closure 53 is at the right as shown in dotted lines in FIG. 2, and that switch S2 is closed and switch S1 open (notch 69 being at the top as viewed in FIG. 6), if a selection is made from any one of the right dispensers D2 by actuating the respective selection switch 75R after having deposited a sufficient amount of money, relay 107 remains energized via switches 95L so that its movable contactor remains down on its lower contact. The respective cycle switch 95R is thrown down when the respective motor M2 starts, breaking circuit 99, deenergizing relay 85 and closing contacts 85*a* to power line 113 and deliver power via line 121, switch S2 (now closed) and lines 123 and 119 to motor 65. The latter operates through a half-revolution cycle of the disk 63 to the point where notch 69 in the disk opens switch S1 and closes switch S2. Switch S1 closes after disk 63 starts rotating and is closed when the disk stops at the end of its half revolution. The closure moves to the left, closing off bank B1 of dispensers from the chute and an article may be dispensed from the dispenser D2, being prevented from sailing into bank B1 by reason of the closure closing off bank B1. When closure 53 is at the right with switch S1 open and switch S2 closed, and a selection is made from any one of the dispensers D1 in the left bank B1 by actuating a selection switch 75L, relay 107 is deenergized, meaning that its movable contactor closes on its upper contact. Since switch S1 is open, motor 65 is not energized and the closure remains at the right.

If the closure 53 is at the left as viewed in solid lines in FIG. 2 and as viewed in FIG. 3, and it is desired to swing out one or more of dispensers D1 for loading, the closure may be moved to the right for this purpose by actuation of switch 125 to energize motor 65 via switch S2. Similarly, if the closure 53 is at the right as viewed in FIG. 2 and it is desired to swing out one or more of dispensers D2 for loading, the closure may be moved to the left for this purpose by actuation of switch 125 to energize motor 65 via switch S1.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Article-dispensing apparatus comprising a cabinet, a first and a second bank of article dispensers in the cabinet, each bank comprising a plurality of dispensers located one above another, each dispenser being adapted to hold a series of articles to be dispensed in a row extending toward one end of the dispenser and having means for feeding the articles toward said one end of the dispenser and discharging the leading article of the series to drop by gravity, the first bank and the second bank of dispensers being arranged in the cabinet with the dispensers of the first bank feeding in one direction and the dispensers of the second bank feeding in the opposite direction and with the discharge ends of the dispensers of the first bank spaced from the discharge ends of the dispensers of the second bank providing a common vertical discharge chute between said banks, said cabinet having a delivery station to which an article delivered from any of the dispensers drops down in said chute, and a closure movable between a first position extending heightwise in said chute at the discharge ends of the dispensers of the first bank for closing off the first bank from the chute and a second position extending heightwise in the chute at the discharge ends of the dispensers of the second bank for closing off the second bank from the chute.

2. Article-dispensing apparatus as set forth in claim 1 having means for holding the closure with the closure extending downward in the chute, said means being movable for moving the closure between its said positions.

3. Article-dispensing apparatus as set forth in claim 2 having means for moving said closure-holding means to move the closure from its first to its second position in response to operation of the apparatus to dispense an article from any dispenser of the first bank and vice versa.

4. Article-dispensing apparatus as set forth in claim 2 wherein said holding means is at the top of the cabinet and holds the closure with the closure hanging down in the chute.

5. Article-dispensing apparatus as set forth in claim 4 having means for moving said closure holding means to move the closure from its first to its second position in response to operation of the apparatus to dispense an article from any dispenser of the first bank and vice versa.

6. Article-dispensing apparatus comprising a cabinet, a first and a second bank of article dispensers in the cabinet, each bank comprising a plurality of dispensers located one above another, each dispenser being adapted to hold a series of articles to be dispensed in a row extending toward one end of the dispenser and having means for feeding the articles toward said one end of the dispenser and discharging the leading article of the series to drop by gravity, the first bank and the second bank of dispensers being arranged in the cabinet with the dispensers of the first bank feeding in one direction and the dispensers of the second bank feeding in the opposite direction and with the discharge ends of the dispensers of the first bank spaced from the discharge ends of the dispensers of the second bank providing a common vertical discharge chute between said banks, said cabinet having a delivery station to which an article delivered from any of the dispensers drops down in said chute, the cabinet having a front, a rear and left and right sides, the first bank of dispensers being located toward one side of the cabinet and feeding in the direction toward the other side and the second bank being located toward said other side of the cabinet and feeding in the direction toward said one side, the delivery station being at the front of the cabinet at the lower end of the chute, the front of the cabinet having an opening for access to the delivery station, a closure, and means for holding the closure with the closure extending down in the chute between the discharge ends of the dispensers of the first and second banks, said means being movable to move the closure between a first position at the discharge ends of the dispensers of the first bank for closing off the first bank from the chute and a second position at the discharge ends of the dispensers of the second bank for closing off the second bank.

7. Apparatus as set forth in claim 6 having means operable when the closure is in its first position to move it to its second position in response to operation of the apparatus to dispense an article from any dispenser of the first bank and vice versa.

8. Apparatus as set forth in claim 7 further having manually operable means for moving the closure from its first to its second position and vice versa.

9. Article-dispensing apparatus comprising a cabinet, a first and a second bank of article dispensers in the cabinet, each bank comprising a plurality of dispensers located one above another, each dispenser being adapted to hold a series of articles to be dispensed in a row extending toward one end of the dispenser and having means for feeding the articles toward said one end of the dispenser and discharging the leading article of the series to drop by gravity, the first bank and the second bank of dispensers being arranged in the cabinet with the dispensers of the first bank feeding in one direction and the dispensers of the second bank feeding in the opposite direction and with the discharge ends of the dispensers of the first bank spaced from the discharge ends of the dispensers of the second bank providing a common vertical discharge chute between said banks, said cabinet having a delivery station to which an article delivered from any of the dispensers drops down in said chute, each dispenser comprising a shelf and a helix rotatable on said shelf adapted for insertion of articles to be dispensed between its convolutions and extending to said discharge end of the shelf, and a closure movable between a first position extending heightwise in said chute at the discharge ends of the dispensers of the first bank for closing off the first bank from the chute and a second position extending heightwise in the chute at the discharge ends of the dispensers of the second bank for closing off the second bank from the chute.

* * * * *